United States Patent [19]

May

[11] Patent Number: 4,904,019

[45] Date of Patent: Feb. 27, 1990

[54] THREE-WAY RECLINER

[75] Inventor: Teddy J. May, Tupelo, Miss.

[73] Assignee: Super Sagless Corporation, Tupelo, Miss.

[21] Appl. No.: 103,886

[22] Filed: Oct. 1, 1987

[51] Int. Cl.[4] ..... A47C 1/02

[52] U.S. Cl. ..... 297/85; 297/68

[58] Field of Search ..... 297/63, 75, 85, 84, 297/83, 317, 318, 88

[56] References Cited

U.S. PATENT DOCUMENTS

| | | | |
|---|---|---|---|
| 3,874,724 | 4/1975 | Re | 297/88 |
| 4,216,991 | 8/1980 | Holobaugh | 297/85 |
| 4,216,992 | 8/1980 | Crum | 297/85 |
| 4,249,772 | 2/1981 | Rogers | 297/68 |
| 4,352,523 | 10/1982 | Holobaugh | 297/68 |
| 4,531,778 | 7/1985 | Rogers | 297/85 |

*Primary Examiner*—Francis K. Zugel

*Attorney, Agent, or Firm*—Wolf Greenfield & Sacks

[57] ABSTRACT

A wall proximity three-position reclining chair capable of being placed immediately adjacent a wall having a seat and arm assembly which moves with respect to a fixed base and which has a backrest movable with respect to the seat. The seat and arm assembly and backrest are carried by a handle actuated mechanism which includes a seat mounting link supported by swing links in turn suspended from a support link. The support link is carried on front and rear pivot links mounted on a roller link which in turn moves fore and aft on the base. A roller link control assembly is connected between one of the swing links and the roller link for moving the roller link to rearwardmost, intermediate and forwardmost positions as the chair assumes the upright, TV and fully reclined positions, respectively.

13 Claims, 5 Drawing Sheets

THREE-WAY RECLINER

INTRODUCTION

This invention relates to reclining chairs and more particularly relates to three-position recliners which may be placed immediately adjacent to a wall or other furniture without interference, when the chair is reclined.

Reclining chairs have enjoyed great popularity for many years. Literally millions of reclining chairs have been sold. The early reclining chairs required that they be placed several feet from the wall or other furniture in order to enable the backrest to recline fully without interference. Many of the early reclining chairs had fixed arms, and to move the chairs to a reclining position, the occupant would push against the arms so as to force his or her body against the backrest. In that type of chair, the reclining action was achieved by tilting the seat and backrest rearwardly and downwardly with respect to the chair arms, which, of course, moved the backrest toward the wall or other furnitures behind it. That motion created the requirement for substantial clearance between the wall and backrest when the chair was upright.

In the late 1960s and 1970s, particularly as housing units became smaller, the chair manufacturers sought ways to modify the construction to enable the chairs to be placed closer to the wall without interference from the wall as they moved from the upright position to a reclining position. Examples of some those chairs, are shown in U.S. Pat. Nos. 3,874,724; 4,077,663; 4,099,776; 4,153,292; 4,195,878 and 4,202,580. Many of these wall proximity chairs employed long tracks, on which the entire chair including the base and frame moved forwardly as the back tilted rearwardly in response to pressure against the arms. In some constructions, the entire chair assembly including the base and frame moved forwardly on the tracks away from the wall to compensate for the rearward tilting of the backrest. Some of those arrangements included channel-shaped tracks twelve inches or more in length. In those chairs roller links are carried by rollers which roll back and forth in the tracks, and the roller links in turn support front and rear pivot links that carry the seat mounting link. The long travel path of the chair frame on the tracks particularly during the reclining action created a feeling of instability for the occupant, which many people found unacceptable. The tracks and rollers also added significantly to the manufacturing costs of the mechanisms.

In seeking to improve the styling of reclining chairs, manufacturers sought ways to enable T-cushions to be used on seats. This was not possible in chairs in which the seat moved rearwardly with respect to the arms, because the wings of the T-cushion would engage the front of the arms and be blocked by them. Thus, the cushion could not travel rearwardly with the seat frame. Consequently, designers sought ways to reverse the direction of motion of the seat with respect to the frame or alternatively to fix the arms with the seat so that they maintained the same relative positions with respect to one another both in the upright and reclining positions of the chair. Because the arms and seat move together in those chairs, means other than pressing against the chair arms had to be found to actuate the chairs. The wide use of handle operated actuating mechanisms in reclining chairs was the result.

More recent developments in the reclining chair art enable the chairs to be placed closer to the wall. Chair mechanisms including combinations of linkages and tracks reduced the wall clearance required, but the industry continues to look for suitable mechanisms which allow reclining chairs to be placed with their backs immediately adjacent with clearance of an inch or less to the wall.

How close to a wall a reclining chair may be placed is by no means the sole criteria of a mechanism's acceptability. The mechanism must, of course, provide a very comfortable relationship between the seat, arms and backrest. It must also require very little effort to operate. The action of the mechanism must be smooth so as not to impart a feeling of instability to the chair user as the chair moves between the upright and reclining positions. Furthermore, the nature of the industry requires that the manufacturing costs be competitive.

The development and manufacture of mechanisms has grown into a separate division within the furniture industry, and at the present time, many manufacturers employ large technical staffs and expend very substantial amounts of time and money in search for improved mechanisms.

In recently filed application Ser. No. 07/067,107 filed June 25, 1987 and assigned to the assignee of this application, an improved mechanism is shown, in which front and rear pivot links are attached to a base plate and support a seat mounting link through a pair of four bar linkage arrangements. To provide smooth reclining action while reducing mechanism costs and at the same time achieving close wall proximity, the front pivot link has a sliding pivotal connection with the base plate while the rear pivot link has a fixed pivot connection to the base plate. The sliding pivotal connection is formed without the use of a track, but instead a roller rides on the base plate itself, and travel is limited by a slot in the base plate through which the roller axle extends. That arrangement permits the chair to be placed four or five inches from a wall and is achieved with a relatively inexpensive mechanism which is smooth and very stable.

The principal object of the present invention is to provide a linkage mechanism for reclining chairs, which enables a chair in which the mechanism is incorporated to be placed with its backrest immediately adjacent a wall (within an inch thereof) without incurring any interference from the wall as the chair moves from upright and to reclining positions.

Another object of the present invention is to provide a relatively inexpensive mechanism having both linkages and a track, which permits the chair to be placed immediately adjacent to the wall.

Another object of this invention is to provide a mechanism for reclining chairs which combines the advantages of a pure linkage mechanism and a track system to achieve a smooth and stable action for reclining chairs.

Yet another object of the present invention is to provide an inexpensive track system for reclining chair mechanisms.

To accomplish these and other objects, the mechanism of the present invention incorporates three different motions into the chair. That is, the motion of the seat and side panel assembly is derived from three separate sources. First, a seat mounting link which carries the chair frame is swingably supported on a support link by swing links. The swing links enable the seat mounting link to move fore and aft with respect to the support link. Second, the support link is mounted on front and rear pivot links secured to a roller link, and the pivot links enable the support link to swing fore and aft with respect to the roller link. Third, the roller link moves fore and aft on the base plate.

When the chair is moved from an upright position to an intermediate or TV position, the support link moves forwardly on its front and rear pivot links with respect to the roller link and simultaneously the roller link moves forwardly on the tracks on the base plate. When the chair moves from the TV position to the fully reclined position, the seat mounting link swings forwardly with respect to the support link and simultaneously the roller links move further forward on the tracks so as to move the frame further away from the wall to provide room for the rearwardly tilting backrest.

A handle actuating mechanism is provided to enable the chair occupant to conveniently extend the footrest and at the same time place the occupant s weight in a position to automatically drive the mechanism to the TV position. Pressure against the backrest when the chair is in the TV position in turn causes the seat mounting link to advance with respect to the support link and thereby advance the roller link on the base plate to achieve the fully reclined position.

The tracks for the roller link of each mechanism are composed of slots formed in the vertical flange of the base plate and rollers on rivet shafts which extend through the slots. The rollers ride on the horizontal flange of the base plate, and the rivet shafts connect the rollers to the roller link. The roller link control assembly causes the roller link to move back and forth on the tracks defined by the slots and reduces the arc through which the front and rear pivot links must swing to recline the chair and provide room for the backrest.

These and other objects and features of the present invention will be better understood and appreciated from the following detailed description of one embodiment thereof, selected for purposes of illustration and shown in the accompanying drawings.

BRIEF FIGURE DESCRIPTION

DETAILED DESCRIPTION

Figure 1:
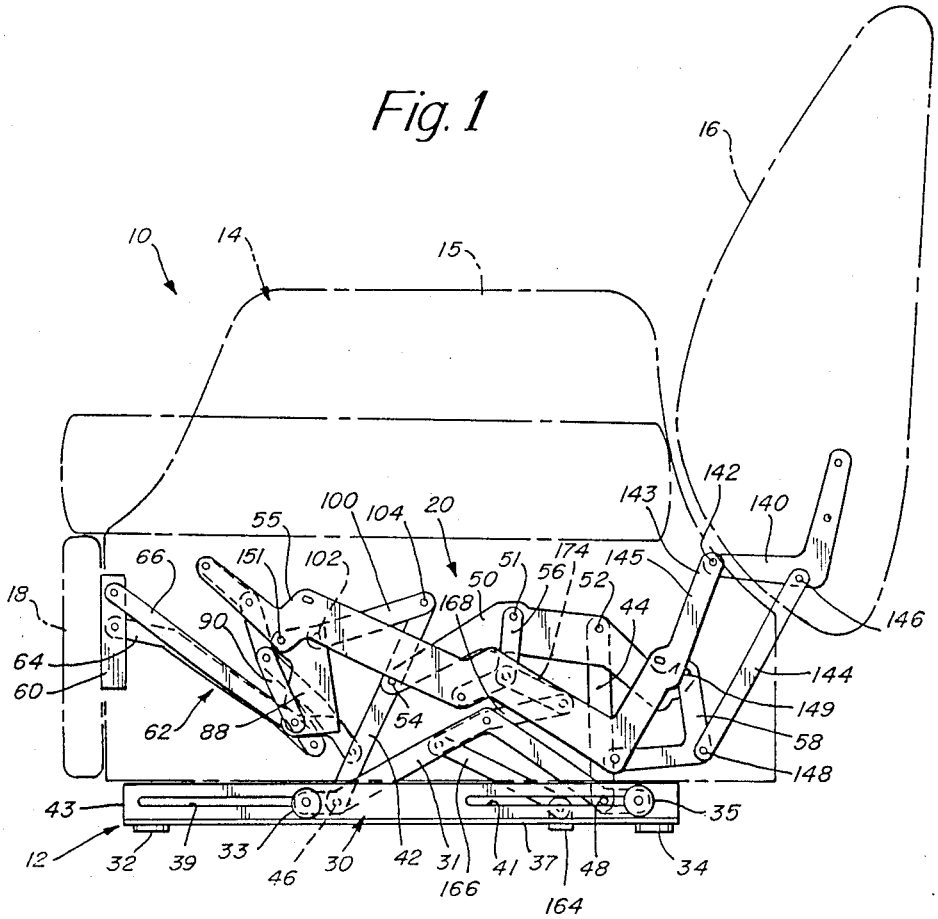
FIG. 1 is a side elevation view of a reclining chair disposed in the upright position and employing the linkage mechanism of this invention.

The present invention is shown embodied in a reclining chair 10 having a base 12, a seat and arm panel assembly 14, a backrest 16 and a footrest 18. The seat and arm panel assembly 14, backrest 16 and footrest 18 are mounted on the base 12 and secured to one another by a pair of linkage mechanisms 20, one on each side of the chair. The two mechanisms are mirror images of one another and only one is described below. The mechanisms 20 enable the chair to move between the upright position shown in FIG. 1, the TV position shown in FIG. 2 and the fully reclined position of FIG. 3, and this may be carried out with the, backrest 16 placed immediately adjacent a wall or other furniture when the chair is upright.

Each linkage mechanism includes a base plate 30 forming part of base 12 and extending front to back of the base. The base plate 30 is formed of a steel angle member (see FIG. 4), and is supported on feet 32 and 34 which protect the floor. As shown in FIGS. 1–3 and 5–7, the base plate 30 carries a roller link 31 supported on front and rear rollers 33 and 35 which run on the base plate horizontal flange 37. The extent of travel of the rollers 33 and 35 with the roller link 31 is limited by the slots 39 and 41 in the vertical flange 43 of the base plate. The subassembly composed of the rollers and slots is described more fully below.

The roller link 31 carries front and rear pivot links 42 and 44 secured to the roller link 31 at their lower ends by rivets 46 and 48, respectively. The front and rear pivot links 42 and 44 in turn are connected to and carry a support link 50. The upper end of rear pivot link 44 is connected to the support link by rivet 52 while the front pivot link 42 is connected to the front end of support link 50 by rivet 54 disposed intermediate the ends of the front pivot link (see FIGS. 2 and 3). In the upright position of the chair shown in FIG. 1, the front pivot link 42 is inclined slightly upwardly and rearwardly from the roller link 31 while the rear pivot link 44 is essentially vertical. The roller link 31, front and rear pivot links 42 and 44, and support link 50 together define a four-bar linkage which permits the support link 50 to move forwardly with respect to the roller link from the position of FIG. 1 to the position of FIG. 2 when the chair is moved from upright to TV position. That action is described more fully below. It will be appreciated from an examination of FIG. 1 and the disposition of the front and rear pivot links 42 and 44 that a downwardly directed force on the support link 50 such as is generated by a person sitting in the chair tends to retain the support link in the position shown That is, the downwardly directed force would not tend to swing the support link 50 in a forward direction with respect to the base plate 30 and roller link 31.

The support link 50 carries a seat mounting link 55 on a pair of swing links 56 and 58. The seat mounting link 55 and the swing links 56 and 58 along with the support link 50 also define a four bar linkage which enables the seat mounting link to move in a swinging motion fore and aft with respect to the support link as is more specifically described below. The seat mounting link 55 is secured directly to the seat and arm panel assembly 14 and carries that assembly with it as the seat mounting link moves from one to another of the positions to which it may move as the mechanism is operated. The pivot links 42 and 44, support link 50, swing links 56 and 58, and seat mounting 55 comprises a linkage assembly supporting the seat and arm assembly on roller link 31.

Figure 2:
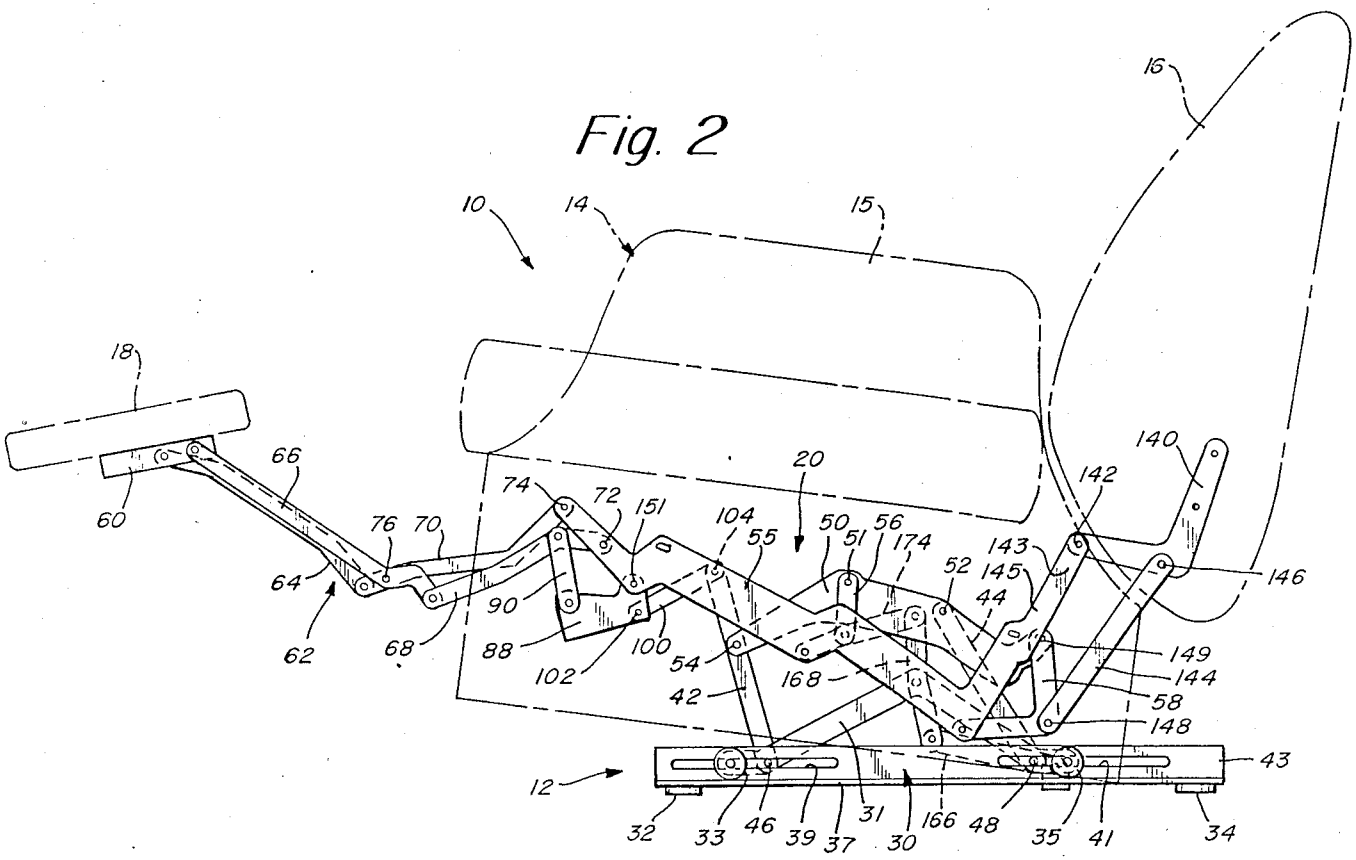
FIG. 2 is a side elevation view similar to FIG. 1 but showing the reclining chair with its mechanism in the intermediate or TV position.
Figure 3:
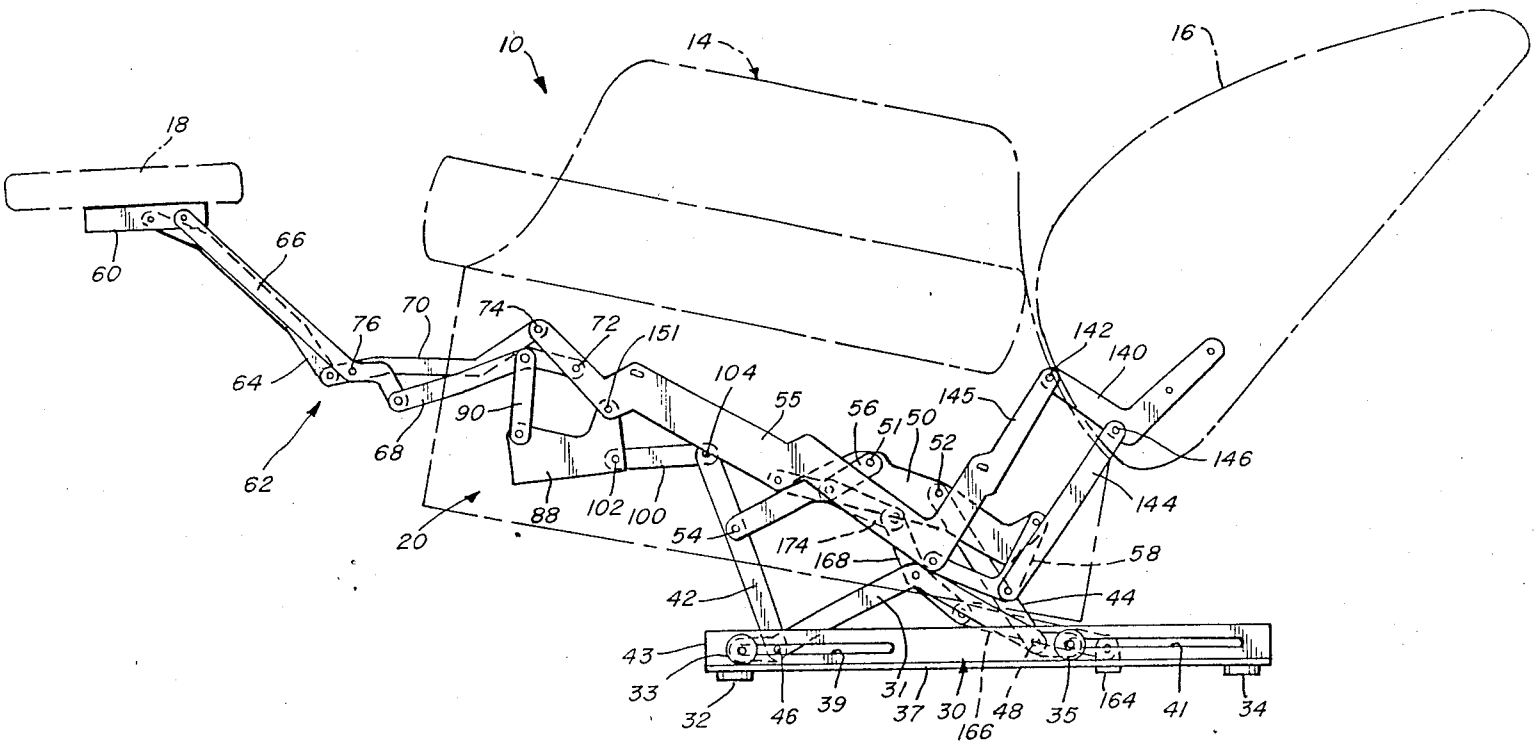
FIG. 3 is a side elevation view similar to FIGS. 1 and 2, but showing the chair in the fully reclined position.

Footrest 18 is best shown in FIGS. 2 and 3 to be mounted on a footrest bracket 60 that in turn is carried by a lazy tong linkage 62 mounted on the forward end of the seat mounting link 55. The lazy tong linkage includes a pair of links 64 and 66 connected at one end to footrest bracket 60 and at their other ends to the links 68 and 70, respectively. Rivets 72 and 74 pivotally connect the links 68 and 70 to the seat mounting link 55. Link 70 is also pivotally connected to the link 66 by rivet 76, which causes the lazy tong linkage to act in the conventional manner so as to extend the footrest 18 to the position of FIGS. 2 and 3 when the linkage is opened and to retract the footrest 18 to the position of FIG. 1 when the lazy tong linkage is closed.

Figure 8:
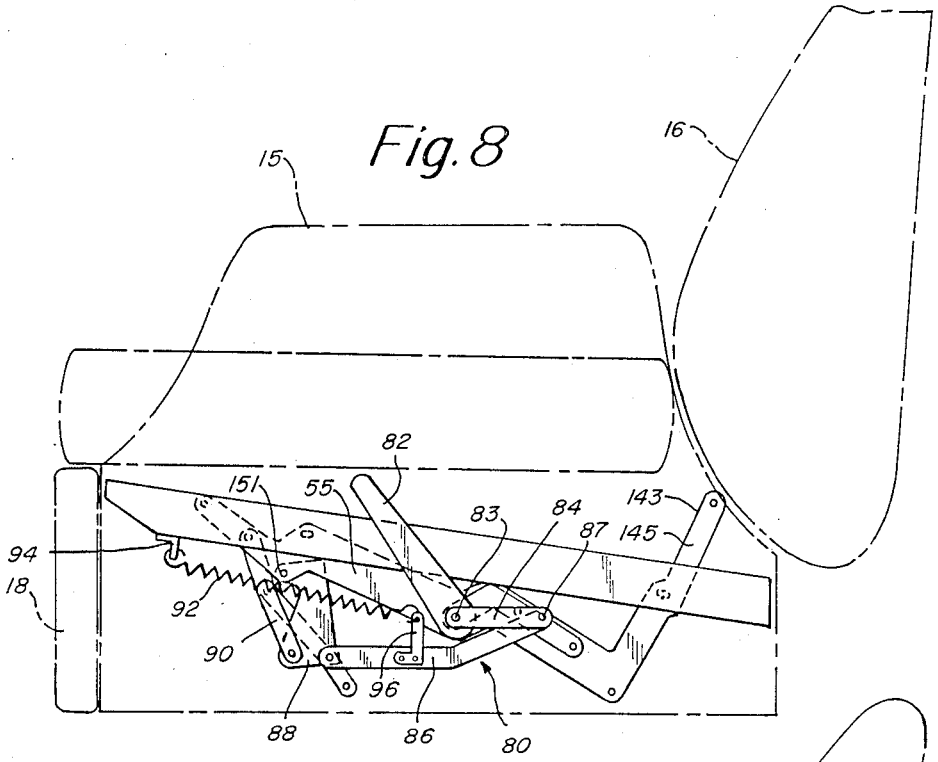
FIG. 8 is a fragmentary side view of the chair in the upright position and showing the handle actuating subassembly connected to the linkage mechanism.
Figure 9:
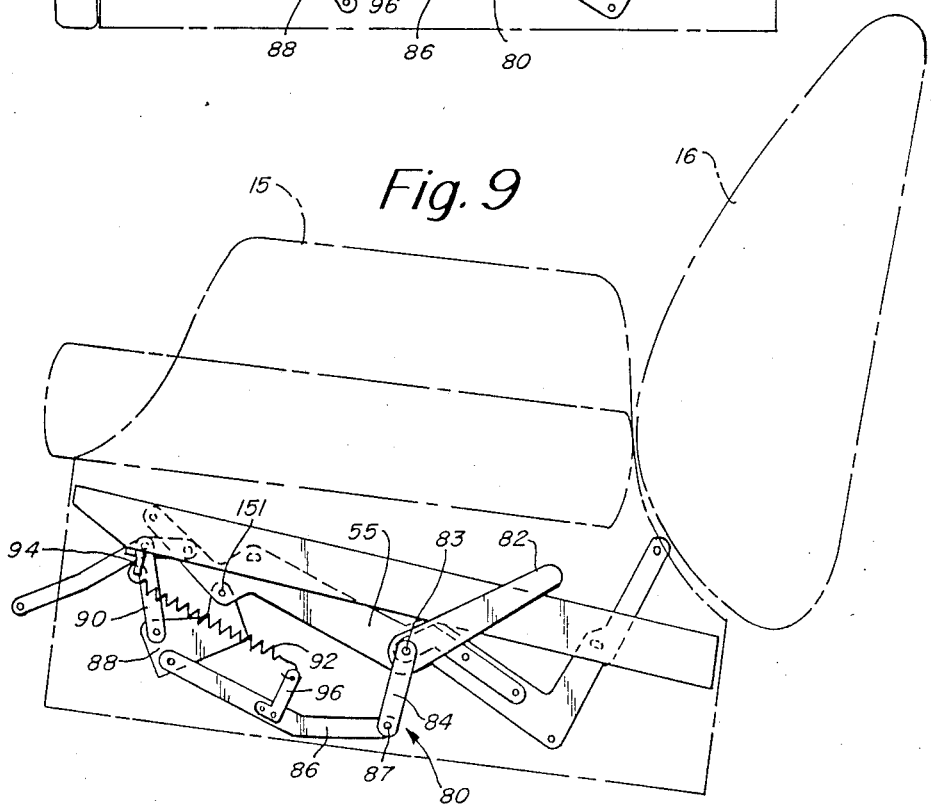
FIG. 9 is a fragmentary side view similar to FIG. 8 but showing the handle actuating subassembly and mechanism in the TV position.

The lazy tong linkage is actuated by a handle assembly 80 shown in FIGS. 8 and 9. The handle assembly 80 includes a handle 82 pivotally mounted on the seat mounting link 55 by pivot pin 83. The handle 82 is keyed to and pivots a first actuating link 84 which in turn is connected to a second actuating link 86 by pin 87. The second actuating link 86 is connected at its forward end to a drive transfer link 88. The drive transfer link 88 in turn is connected by a sequencing link 90 to the lazy tong link 68.

When the second actuating link 86 moves to the left from the position shown in FIG. 8 to that of FIG. 9, it pivots the drive transfer link 88 in a clockwise direction, which in turn elevates the sequencing link 90 so as to cause the lazy tong linkage to open and elevate footrest 18 (see also FIGS. 2 and 3). This action is assisted by a coil spring 92 extending under tension between an eye 94 on the side panel assembly 14 and a bracket 96 fixed to the second actuating link 86. Spring 92 urges the actuating link 86 to the left, and this in turn causes the action of the drive transfer link 88 and sequencing link 90 described above. As a result, very little force need be applied to handle 82. When the handle pivots clockwise as viewed in FIG. 8 and causes the pin 87 to pass over the axis of spring 92, the spring 92 will immediately take over and provide the force required to elevate the footrest.

A footrest drive link 100 is also pivoted at one end to the drive transfer link 88 by rivet 102 (see FIGS. 1 and 3), and its other end is pivoted by means of rivet 104 to the upper end of front pivot link 42. The manner in which the footrest drive link 100 cooperates with the drive transfer link 88 in the movement of the chair between its various positions is described more fully below in connection with the operation of the chair.

The chair mechanism also includes a backrest bracket or mounting link 140 pivoted by rivet 142 to the upper end 143 of arm 145 which is integral with and part of the seat mounting link 55. The bracket 140, as is evident in the drawings, supports backrest 16 for pivotal motion with respect to the seat and arm panel assembly 14. The bracket 140 is supported by a back support link 144 connected to it by rivet 146. Link 144 is also connected by rivet 148 to the rear swing link 58. When the backrest is pivoted rearwardly about rivet 142 with respect to the seat and arm panel assembly 14, the back support link 144 pushes the lower portion of the rear swing link 58 in a forward direction causing that link to pivot clockwise about rivet 149, which in turn causes the seat mounting link 55 to swing in a forward direction with respect to the support link 50.

Figure 4:
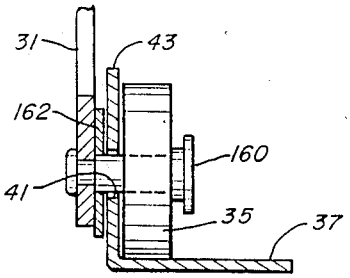
FIG. 4 is a fragmentary rear elevation view showing the track and roller which support the back end of the roller link on the base plate.

As is evident in FIGS. 1–3 and 5–7, the roller link 31 moves from a rearwardmost position on the base plate when the chair is upright to a forwardmost position on the base plate when the chair is fully reclined, and when the chair is in the intermediate or TV position, the roller link 31 assumes an intermediate position on the base plate 30. In FIG. 4, the rear roller assembly is shown in detail, and it is to be appreciate that the same construction is used at the front roller assembly. Specifically, the roller 35 is shown disposed for rolling motion on horizontal flange 37 of the base plate 30. The roller is connected by a rivet 160 to the rear end of the roller link 31. The rivet 160 extends through the slot 41 in the vertical flange 43 of the base plate 30, and a washer 162 on the rivet between the roller link 31 and vertical flange 43 reduces friction. The slot 41 in cooperation with the horizontal flange forms a track of limited length for the roller 35.

Figure 5:
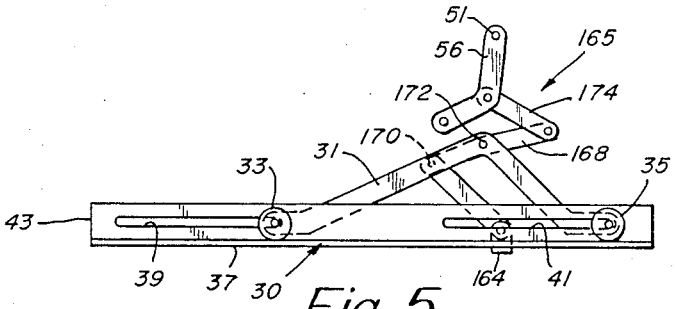
FIGS. 5–7 are similar fragmentary views of the mechanism including the roller link actuating assembly in the upright, TV and fully reclined positions, respectively.
Figure 6:
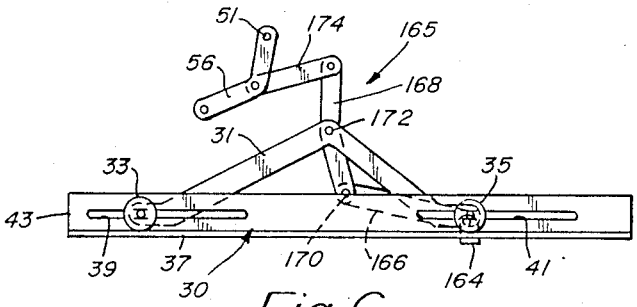
Figure 7:
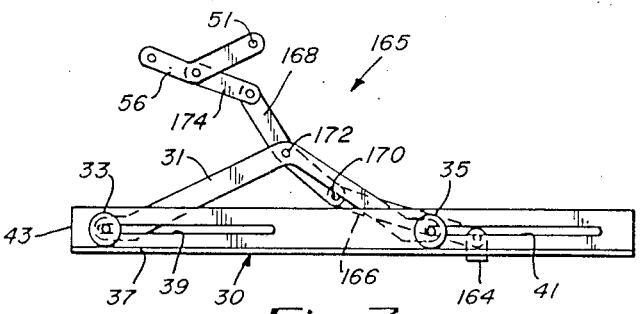

The roller link 31 is caused to move on the base plate 30 as the chair moves from one position to another by the roller link actuator assembly 165 shown clearly in FIGS. 5–7. In those figures, a bracket 164 is shown fixed to the base plate 30, to which is pivotally connected one end of a drive lever 166. The other end of lever 166 is connected to a crank 168 by pivot rivet 170. The crank 168 is pivotally mounted intermediate its ends by rivet 172 on the roller link 31, and the other end of crank 168 is connected by link 174 to the front swing link 56.

When the front pivot link 42 is pivoted counterclockwise about its pivot rivet 46 in response to actuation of the drive transfer link 88 in turn actuated by movement of the handle assembly, support link 50 moves in a forwardly direction (to the left as viewed in FIG. 1) and swing links 56 and 58 move with it and carry the seat mounting link 55 as well. The geometry of the four-bar linkage made up of the links 50, 55, 56 and 58 remains essentially constant and moves as unit forwardly with respect to the base plate 30. As swing link 56 moves in a forward direction, it pulls connecting link 174 with it, which in turn causes the crank 168 to pivot counterclockwise about pivot rivet 172 and its lower end to push against the end of drive link 166. That action in turn drives the roller link 31 forwardly on the base plate approximately two-thirds the length of the slots 39 and 41 to the position shown most clearly in FIG. 6.

When the seat link 55 swings forwardly on the swing links 56 and 58 with respect to the support link 50 swing link 56 pivots clockwise about the pivot rivet 51, which draws link 174 further to the left as viewed in FIGS. 6 and 7, which in turn pivots crank 168 counterclockwise to drive the roller link 31 to its forwardmost position as the seat moves from the TV position to the fully reclined position.

The chair operates as follows:

An occupant of the chair sitting upright with the chair in the position of FIG. 1 and wishing to recline the chair to the TV position of FIG. 2 or the fully reclined position of FIG. 3 merely pulls the top of handle 82 rearwardly from the position of FIG. 8 to the position of FIG. 9. This action causes the first and second actuator links 84 and 86, respectively, to pivot clockwise about the rivet 83 and move toward the front of the chair so as to pivot the drive transfer link 88 from the position of FIG. 1 to the position of FIG. 2. As the pin 87 passes across the axis of the spring 92, this actuation is assisted by the spring, which serves to draw the second actuator link 86 in a forward direction.

Rotation of the drive transfer link 88 about its pivotal mounting 151 on the seat link 55 does several things. First, it draws the drive link 100 downwardly and to the left from the position of FIG. 1 to the position of FIG. 2, which in turn causes the front pivot link 42 and rear pivot link 44 to move over center (across the vertical position). As a result, the downwardly directed force applied by the weight of the occupant causes the support link 50 to move forwardly and downwardly with respect to the roller link 31 which supports it. That action in turn draws the swing link 56 forwardly and through the action of the connecting link 174, crank 168 and drive lever 166, pushes the roller link forwardly to the position of FIG. 6. The weight of the occupant also pushes the drive link 100 further downwardly and assists in rotating the transfer link 88 about its pivotal support 151. Second, the pivotal shifting of the drive transfer plate 88 acts upon the sequence link 90 to pivot the lazy tong link 68 about its pivotal support 72 on the seat mounting link 55 and thereby extend the lazy tong linkage 62 and elevate the footrest 18 to the position of FIG. 2.

The pivot links 42 and 44 pivot forwardly to move the seat and back assembly to the left (as viewed in FIG. 1). That motion is enhanced by the forward travel of the roller link 31 on the base plate 30. The motion of the roller link reduces the arc through which the pivot links 42 and 44 must move to achieve the necessary forward motion of the seat and arm assembly 14 on the base plate 30 to enable the backrest 16 to pivot rearwardly without inference from a wall or other furniture immediately adjacent the back of the backrest Consequently, the front edge of the seat does not tip downwardly, and a very comfortable seat angle is achieved. During this sequence, the seat mounting link 55 remains essentially fixed with respect to the support link 50. That is, the two move forward together as the support link 50 swings in a forward direction as the front and rear pivot links 42 and 44 pivot counterclockwise as viewed in FIGS. 1 and 2 and the roller link 31 advances on its tracks. Thus, the seat assembly 14 comprising the seat and arm panels, along with the backrest 16, which are all carried either directly or indirectly by the seat mounting link 55 advance from the upright position shown in FIG. 1 to the TV position of FIG. 2. The top of backrest 16 pivots slightly rearwardly in a clockwise direction. The forward movement of the seat and arm panel assembly 14 and the backrest 16 by the action of the front and rear pivot links 42 and 44 and the forward movement of the roller link 31 more than compensates for the change in angle of the back from upright to TV position so as to prevent the backrest from engaging the wall or other furniture. The joint action of the pivot links 42 and 44 and the roller link 31 provides added stability to the chair as it reclines by reducing the arc of travel of the pivot links and also provides a smoother operating action. Furthermore, the forces necessary to open (and close) the chair are reduced.

If the occupant in the TV position wants to place the chair in the fully reclined position of FIG. 3, he or she need only push against the arms 15 and backrest 16. This action causes the backrest bracket 140 to pivot on its support 142 in a clockwise direction from the position of FIG. 2 to the position of FIG. 3, and the backrest support link 144 as a result rotates the rear swing link 58 about its pivotal connection 149 on the support link 50, which advances the seat mounting link 55 with respect to the support link 50. This action also causes the front swing link 56 to turn the crank 168 and thereby drive the roller link to its fowardmost position on its tracks defined by the slots 39 and 41 and roller 33 and 35. The advance of the seat mounting link 55 on the roller link 31 through the support link 50 and the advance of the roller link 31 on the base plate 30 together cause the seat and arm panel assembly 14 as well as the backrest 16 to move further forward on the base plate 30 to the position shown in FIG. 3. During this action, the footrest 18 remains essentially fixed with respect to the seat. The additional motion of the entire assembly away from the wall provides more than enough room for the backrest 16 to pivot rearwardly with respect to the seat without interference from the wall adjacent which the chair is placed.

To return the fully reclined chair to the TV or upright positions of FIGS. 2 and 1, the occupant need only relieve the pressure against the backrest 16. This will cause the seat mounting link 55 to swing rearwardly on the swing links 56 and 58 suspended on support link 50, which also will cause the roller link 31 to travel from the position of FIG. 7 to that of FIG. 6. The chair thus will return to the position of FIG. 2. It should be appreciated that by applying the appropriate pressure against the backrest 16, the occupant may maintain the chair in any intermediate position between those shown in FIGS. 2 and 3.

To proceed to the fully upright position, the occupant need only apply a downward pressure on the footrest 18, which will close the lazy tong linkage 62 and pivot the drive transfer link 88 in a counterclockwise direction about its mounting 151 on the seat mounting link 55, which in turn will cause the front pivot link 42 to pivot clockwise and impart the same action to the rear mounting link 44. This in turn will cause the roller link drive assembly 165 comprising connecting link 174, crank 168 and lever 166 to push the roller link 31 rearwardly on the base plate 30. In this fashion, the chair moves to the fully upright position.

From the foregoing, it will be appreciated that a chair constructed in accordance with the present invention have a normal back height of approximately 36 inches may be placed immediately adjacent to the wall (within an inch thereof) and will nevertheless be able to move to the fully reclined position without interference. The combination of the linkage and the continuously moving roller link 31 provides sufficient forward travel of the seat assembly 14 and backrest 16 on the base plate so as to compensate for the angle change of the backrest as it moves from the upright to the TV position and on to the fully reclined position.

The mechanism of the present invention, while substantially less expensive than the mechanisms of the prior art having channel-shaped tracks on the base plate for the rollers, nevertheless enables a chair to be placed immediately adjacent to a wall or other furniture without any interference with its reclining action.

The continuous travel of the roller link during each phase of the reclining action provides a more stable platform for the chair with increased comfort for the occupant. The sense of instability present in some of the prior art chairs, which is unsettling to some users, is eliminated. Furthermore, the force required to recline the chair is reduced.

Having described this invention in detail, those skilled in the art will appreciate that numerous modifications may be made of the invention without departing from its spirit. Therefore, it is not intended that the scope of this invention be limited to the single embodiment illustrated and described. Rather, the scope of this invention is to be determined by the appended claims and their equivalents.

I claim:

1. A three-position reclining chair having a base, a seat and arms assembly, a backrest, and a mechanism on each side of the base for supporting the assembly and backrest on the base for movement between upright, TV and reclining positions, each of said mechanisms comprising a base plate, a roller link movable fore and aft on the base plate between front and rear extreme positions, front and rear pivot links pivotally mounted on the roller link and carrying a support link above the roller link for swinging movement therewith, a pair of swing links extending downwardly from the support link and carrying a seat mounting link for fore and aft swinging motion with respect to the support link, a backrest mounting link pivotally connected to the seat mounting link and carrying the backrest, handle operated actuating means mounted on the seat mounting link for pivoting the pivot links to initiate movement of the support link to move the seat and backrest from the upright to the TV position without moving the swing links relative to the support links, means forming part of the mechanism and responsive to backwardly directed pressure on the backrest when the chair is in the TV position to move the set backrest to the fully reclined position, and roller link actuating means connected to the roller link and one of the swing links for moving the roller link to an intermediate position between the extreme positions in response to movement of said one swing link with the support link when the seat and backrest move to the TV position and to move the roller link to the forwardmost position in response to swing motion of said swing link when the seat and backrest move from the TV position to the fully reclined position.

2. A reclining chair as defined in claim 1 wherein the roller link actuating means includes a crank pivotally mounted intermediate its ends on the roller link, a lever fixed at one end to the base plate and at its other end to one end of the crank, and a connecting link connected at one end to the other end of the crank and at its other end to said one of the swing links.

3. A reclining chair as defined in claim 1 wherein a pair of rollers are connected to the roller link and ride on the base plate, and a shaft for the rollers extending through slots in the base plate for guiding the travel of the roller link on the base plate.

4. A reclining chair as defined in claim 3 wherein the roller link actuating means includes a crank pivotally mounted intermediate its ends on the roller link, a lever fixed at one end to the base plate and at its other end to one end of the crank, and a connecting link connected at one end to the other end of the crank and at its other end to said one of the swing links.

5. A reclining chair as defined in claim 1 wherein a footrest is carried by the mechanism and is actuated by the handle operated actuating means to the elevated position as said actuating means initiates movement of the support link.

6. A reclining chair as defined in claim 2 wherein a footrest is carried by the mechanism and is actuated by the handle operated actuating means to the elevated position as said actuating means initiates movement of the support link.

7. A reclining chair as defined in claim 4 wherein a footrest is carried by the mechanism and is actuated by the handle operated actuating means to the elevated position as said actuating means initiates movement of the support link.

8. A reclining chair as defined in claim 3 wherein said base plate is L-shaped in cross-section with a horizontal flange on which the rollers ride and a vertical flange in which the slots are formed.

9. A reclining chair comprising a seat, a backrest, and a mechanism for supporting the seat and backrest for movement from an upright to a TV and fully reclined positions, said mechanism including a base plate, a roller link mounted for movement from a rearward to an intermediate and to a fully forward position on the base plate, a linkage assembly mounted on the roller link and carrying the seat and enabling the seat to move forwardly with respect to the roller link as the chair moves from the upright to the TV and from the TV to the fully reclined positions, a backrest mounted for pivotal movement on the seat, means connected between the backrest and the seat causing the seat and backrest to remain essentially fixed with respect to one another as the chair moves between the upright and TV positions and causing the backrest to pivot rearwardly with respect to the seat as the chair moves from the TV to the fully reclined position, and a roller link actuating assembly connected to the roller link and the linkage assembly causing the roller link to move from the rearward to the intermediate position from the upright position in response to movement of the seat from the upright to the TV position and from the intermediate to the fully forward position on the base plate as the backrest pivots rearwardly with respect to the seat.

10. A reclining chair defined in claim 9 wherein the roller link actuating assembly includes a crank mounted for pivotal movement on the roller link, a lever connected between the crank and the base plate, and a link connected between the crank and the linkage assembly.

11. A reclining chair as defined in claim 9 wherein a footrest is carried by a linkage connected to the linkage assembly and causing the footrest to be elevated when the chair is in the TV and fully reclined positions.

12. A reclining chair as defined in claim 9 wherein a pair of rollers are connected to the roller link and ride on the base plate, and a shaft for the rollers extending through slots in the base plate for guiding the travel of the roller link on the base plate.

13. A reclining chair as defined in claim 12 wherein said base plate is L-shaped in cross-section with a horizontal flange on which the rollers ride and a vertical flange in which the slots are formed.

* * * * *